United States Patent [19]

Sorensen et al.

[11] Patent Number: 4,771,891

[45] Date of Patent: Sep. 20, 1988

[54] PATTERNED ADHESIVE LABEL STRUCTURES

[75] Inventors: Terry J. Sorensen, Sherman Oaks; Bill W. Wyss, Glendora, both of Calif.

[73] Assignee: Avery International Corporation, Pasadena, Calif.

[21] Appl. No.: 873,372

[22] Filed: Jun. 12, 1986

[51] Int. Cl.[4] ..... B65D 17/50

[52] U.S. Cl. ..... 206/459; 40/312; 40/638; 156/291; 206/605; 428/40; 428/195

[58] Field of Search ..... 40/2 B, 2 R, 312, 313; 156/291; 206/447, 460, 607, 611, 615, 626, 630–633, 605; 229/7 R, 181; 428/40–42, 195, 198, 202

[56] References Cited

U.S. PATENT DOCUMENTS

| | | | |
|---|---|---|---|
| 282,920 | 8/1883 | Plimpton | 156/291 |
| 2,636,297 | 4/1953 | Johnson | 428/41 |
| 2,740,547 | 4/1956 | Huntting | 229/485 B |
| 3,127,082 | 3/1964 | Meyer-Jagenberg | 229/7 R |
| 3,203,621 | 8/1965 | Wright | 206/633 |
| 3,410,393 | 11/1968 | Lee | 428/41 |
| 4,128,954 | 12/1978 | White | 428/40 |
| 4,194,680 | 3/1980 | Scott et al. | 206/611 |
| 4,258,876 | 3/1981 | Ljungcrantz | 206/633 |
| 4,260,061 | 4/1981 | Jacobs | 206/633 |
| 4,630,729 | 12/1986 | Hirt et al. | 229/48 T |

FOREIGN PATENT DOCUMENTS

| | | | |
|---|---|---|---|
| 0021062 | 12/1936 | Australia | 156/291 |
| 0122847 | 10/1984 | European Pat. Off. | 428/40 |
| 2236153 | 2/1974 | Fed. Rep. of Germany | 156/291 |
| 2709167 | 9/1978 | Fed. Rep. of Germany | 156/291 |
| 3433293 | 3/1986 | Fed. Rep. of Germany | 428/40 |
| 2003827 | 3/1979 | United Kingdom | 428/41 |

*Primary Examiner*—Jimmy G. Foster

*Attorney, Agent, or Firm*—Poms, Smith, Lande & Rose

[57] ABSTRACT

A self-adhesive label has discrete areas having differently patterned adhesive coverages. Thus, areas where permanent adhesion is desired have full or 100% coverage of a permanent adhesive whereas areas where lesser adhesion is desired have fine patterns with lesser percentages of coverage, such as 30% coverage of the same adhesive which would permit a resealable mode of operation. This type of label could be applied from backing tape to a cereal box, for example, to control operation of a dispensing flap or spout.

11 Claims, 6 Drawing Sheets

PATTERNED ADHESIVE LABEL STRUCTURES

FIELD OF THE INVENTION

This invention relates to adhesive labels having variable patterns of adhesive material on different areas of the labels.

BACKGROUND OF THE INVENTION

In the field of self-adhesive labels, it is customary to coat fully all or at least most of the areas of a label with adhesive material. Further, the adhesive materials are normally classified as permanent type adhesives or removable adhesives. When a label is fully coated with a permanent type adhesive, and is applied to a product, it normally cannot be removed without destroying either the label or the produce upon which is is mounted. On the other hand a coating of a removable adhesive material will permit the label to be peeled off, and re-applied.

The nature of an adhesive, whether permanent or removable, is often specified by the force required to peel (peel force) a one inch sample strip at right angles from a stainless steel surface to which it has been adhered. Standards and procedures for measuring peel forces have been established by the Pressure Sensitive Tape Council, and the peel forces as used herein relate to tests made pursuant to such standard procedures. The designation "permanent adhesives" is normally applied to adhesives having peel forces in the order of 3 pounds or more, while adhesives having a peel force of less than about 2 pounds are normally referred to as removable adhesive coatings.

More generally, when the entire system including the label, adhesive, and underlying surface such as a product box, are considered, a permanent adhesive is one wherein a full coating will prevent removal of the label without impairing the structural integrity of the label or the underlying surface; while a removable label is one which will not affect the structural integrity of the label or the underlying surface, but which may be peeled back and re-used. Further, the strength of the label may be increased by forming the face stock from which the label is made from material containing long fibers, or by pre-coating the label surface with a high strength plastic coating. Using such high strength labels, a higher peel force for the adhesive may be tolerated, with the labels still being removable.

One object of the present invention is to provide a label using a single type of adhesive which will provide a permanent bond on one area of the label and a weaker, removable adhesive on other areas of the label.

It has previously been proposed to have patterns of adhesive applied to tapes or the like without fully covering the area, or with a thicker layer on one portion of the surface than on another area. Typical prior U.S. patents of this type include the following:

J. V. Bauer et al. U.S. Pat. No. 2,294,347, g. Aug. 25, 1942

H. A. Evans, U.S. Pat. No. 2,349,710, g. May 22, 1944

L. B. Schrans, U.S. Pat. No. 2,721,810, g. Oct. 25, 1955

A. G. Patchell, U.S. Pat. No. 2,940,868, g. June 14, 1966

T. F. Banigan, Jr., et al., U.S. Pat. No. 3,039,893, g. June 19, 1962

N. Warshens, U.S. Pat. No. 2,684,316, g. July 20, 1954

C. W. Vogt, U.S. Pat. No. 2,867,317, g. Jan. 6, 1959

However, these patents do not solve the problem of providing a label having a permanent bond in one area of the label and reclosable self-adhesive properties in another area of the label. Accordingly, an important object of the invention is to provide such a label.

SUMMARY OF THE INVENTION

In accordance with one aspect of the present invention, it has been determined that adhesives of the type normally known as permanent adhesives may be applied to fully cover one area of a label so as to form a permanent bond with the underlying substrate, and may be applied in a fine pattern to other areas of the label, with the result that the label may be peeled back and resealed in these other areas where the fine pattern of the "permanent" adhesive is located, without imparing the structural integrity of the label or the product container to which it is applied.

Incidentally, of course, if the adhesive pattern is too coarse, the label or the underlying package will not maintain structural integrity and may tear at the areas where the permanent adhesive is located when an attempt is made to peel back the label.

In accordance with a feature of the invention, the label as described hereinabove may be applied to a product box, including granulated type product, for example, with a U-shaped perforation in the box forming a pouring flap, and the label permanently adhered to the box and to the flap, and with a fine pattern of adhesive around the perimeter of the flap for reclosing or resealing the package between uses.

In accordance with a further feature of the invention, labels of the types described above may be provided with perforated ungummed "rip strip" areas between two adhesive coated areas.

It is further noted that labels of the types described above may be mounted on a backing strip with a release layer between the adhesive and the backing strip so that the labels may be dispensed over a peeling blade from a roll in the usual manner.

The adhesive coverage on selected areas of the labels may range continuously from zero percentage area coverage up to 100% coverage, or in steps, as desired. The pattern in the fine pattern coverage areas, whether the pattern is regular or irregular in its configuration, may be a series of dots, a series of spaced lines, cross-hatching, parallelograms, a variable or changing pattern, or any other desired configuration. Patterns from 85 lines per inch to 25 lines per inch have been successfully used with permanent adhesive, to obtain peelable, resealable, adhesive, with wider lines of adhesive being used to vary the percentage coverage in the ranges of 20%, 40%, 60%, 80% and full coverage. Good resealable action was obtained with 20% and 40% area coverage, using an adhesive coating about 0.001 inch thick of a permanent adhesive having a peel force of about 4.5 pounds under the standard test conditions mentioned above. Using 25 lines per inch and a 50% coverage, the width of the lines of adhesive are about 0.020 inch (one fiftieth of an inch) which is a sufficiently fine pattern so that the spaced lines of permanent adhesive act like full coverage of a removable or resealable adhesive, having a relatively low peel force. However, if the areas of the permament adhesive are coarse, such as $\frac{1}{8}$ inch wide lines or dots, the label face stock or the product box often will not maintain structural integrity. In general, therefore, it is typical that the lines or dots of the permanent adhesive not be more than about $\frac{1}{8}$ inch (0.125)

wide or not have a diameter of more than about ⅛ inch, and preferably not more than 1/16 inch (0.0625) in both cases.

Other aspects or features of the invention include the following:

1. A fine pattern of adhesive with a medium percentage coverage over much of its area and with a low percentage coverage only at one end or corner of the label, may be used for ease in starting to peel the label from the backing paper or the surface to which it is adhered.

2. For removable note purposes the notes may be mostly "ungummed", or free of adhesive, and are provided with a fairly heavy percentage fine pattern spaced slightly inward along the intended top of the notes, with a lighter line adhesive pattern at the top and along the edges near the top, to prevent curling of the notes.

3. The principles described above for permanent adhesive may also be employed using adhesives having somewhat lower peel forces, to provide variable resealable peel forces over the entire surface of the label.

4. The fine pattern of adhesive may be oriented so that in peeling the label the lines of adhesive are at an angle to the direction of peel, so that the peel force encountered by the user is relatively uniform.

5. The peel force may be varied by varying the percentage coverage, including the thickness of the lines, by varying the thickness of the adhesive coating, and the formulation of the adhesive.

Other objects, features and advantages of the invention will become apparent from a consideration of the following detailed description and from the accompanying drawings.

DETAILED DESCRIPTION

Figure 1:
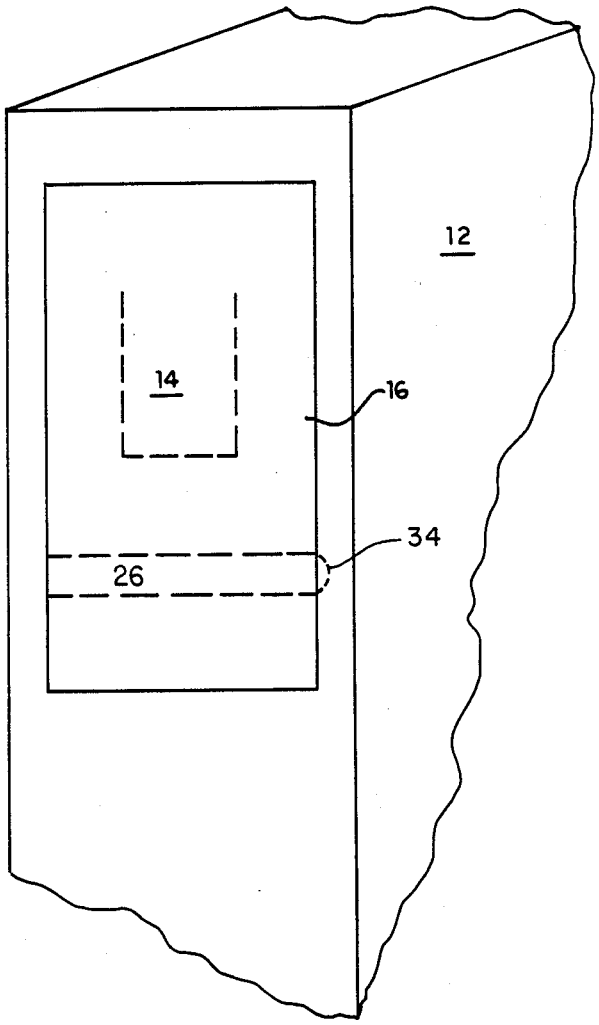
FIG. 1 is an isometric view of a product box provided with a resealable label flap closure, illustrating the principles of the present invention.
Figure 2:
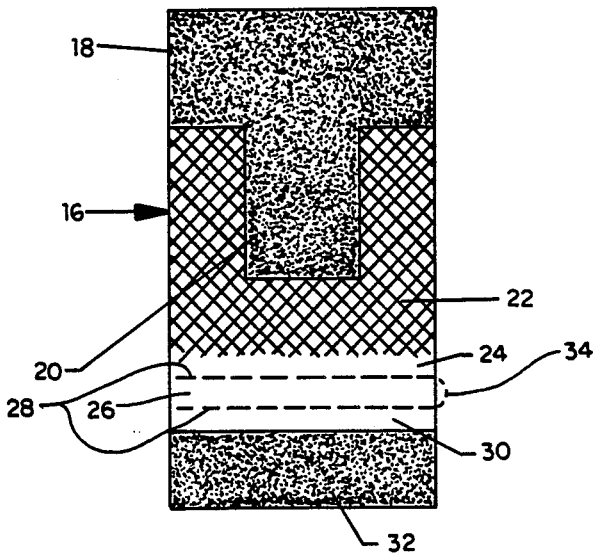
FIG. 2 is a view of the back of the label of FIG. 1 to which adhesive has been selectively applied in a pattern.

Referring more particularly to the drawings, FIG. 1 shows a product box 12 having a U-shaped perforated flap type opening 14 which is located underneath a special label 16. The construction of the label 16 is shown in greater detail in FIG. 2 of the drawings. In FIG. 2, showing the adhesive coated side of the label, it may be seen that the adhesive on the label 16 fully covers the upper end 18 of the label, and also extends downwardly in the area 20 to precisely overlie the flap 14 in the box 12. The remainder of the label 16 includes the area 22 which has a light patterned coverage of adhesive, the ungummed area 24 at the lower edge of the upper portion of the label, the tear strip 26 which is separated from the other two portions of the label by the perforations 28 so that it may easily be ripped off, the ungummed portion 30 below the tear strip 26, and finally, the lower end of the label 32 which is provided with full adhesive coverage so that the tear strip 26 may be pulled loose without pulling off the lower end of the label 32. The tear strip 26 may be provided with an additional extension portion 34, if desired for convenience in starting to rip the strip off.

In practice, the tear strip 26 is initially removed, and then the upper portion of the label is raised, starting from the lower ungummed area 24. The fully adhesive covered area 20 adheres fixedly to the flap 14 and pulls it out from the side of the box 12. As the label is raised, the flap 14 pivots about the imaginary line joining the two upper ends of the "U" which defines the flap. After a small quantity of the product has been poured from the box 12 through the opening provided by flap 14, the flap 14 and the upper portion of the label are folded back down, and the lightly patterned area 22 seals the flap in place against the side of the box 12. With the light pattern on the area 22, the flap can be readily raised many additional times, and still hold the flap 14 down in its closed position to keep the contents of the box substantially sealed, when product is not being poured out of the opening 14.

The adhesive on the label 16 is preferably of the type known as "permanent" self adhesive material. Using standard measuring techniques in accordance with Pressure Sensitive Tape Council, permanent adhesives normally have a peel force of three or four or more pounds per one inch strip, measured perpendicular to the orientation of the tape on a stainless steel base member, while removable self-adhesive materials normally have a peel force of less than about 2 pounds. Characteristically, with permanent adhesives, the label or the underlying base material will not maintain structural integrity and will come apart or be destroyed, rather than permitting the label to be peeled off.

However, using removable or resealable adhesives, the label and the underlying product such as the box 12 will retain their structural integrity as the label is being peeled back. Similarly, as discussed above, when a fine pattern of permanent adhesive is applied to the area 22, it acts like removable or resealable adhesive material in a full coating, and can be opened and resealed many times without either the label or the box losing its structural integrity. The spacing of the lines of adhesive in the label of FIG. 2 is 25 lines per inch, and the percentage coverage is 30%. However, depending on the peel force of the adhesive, and the strength of the substrate and label, the fine pattern configuration and percentage coverage may be varied, as discussed above.

It may also be noted that the perforations 36 around the flap 14 as shown in FIG. 1 should have substantial "cut" portions and relatively short "ties" between the cut portions so that the flap can be pulled loose from the box relatively easily. After removing the tear strip 26, when the label 24 is raised, the flap 14 is pulled loose from the box along its perforations. If necessary, of course, after the label is raised to the edge of the flap 14, additional mechanical force such as the application of a knife blade or fingernail may be employed to assist in initially starting the opening of the flap 14.

Figure 3:
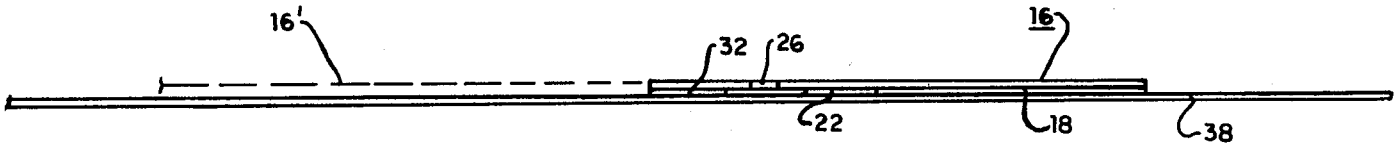
FIG. 3 is a side view of a series of labels of the type shown in FIGS. 1 and 2, with the labels being mounted on a backing strip.

Turning now to FIG. 3, this figure shows a series of labels 16, 16' mounted on a backing strip 38. The adhesive 18, 22, 32 as shown in FIG. 2 is on the side of the label 16 which is facing the backing strip 38. In accordance with the usual practice in the manufacture of labels a release coating is provided on the surface of the backing tape 38, so that, when the tape is drawn over a peeling blade, the labels 16, 16' are separated from the backing tape and are dispensed onto the product. In practice, the backing tape, together with the labels, may be wound up on a reel, and the labels are applied to a series of boxes such as the boxes 12, in the proper location, by running the tape and the labels over a peeling blade as the boxes are moved past the label applicator station, by suitable conveying arrangements. For other applications, the labels may be mounted on sheets, which would constitute another form of backing, to which a release coating would be applied.

Figure 4:
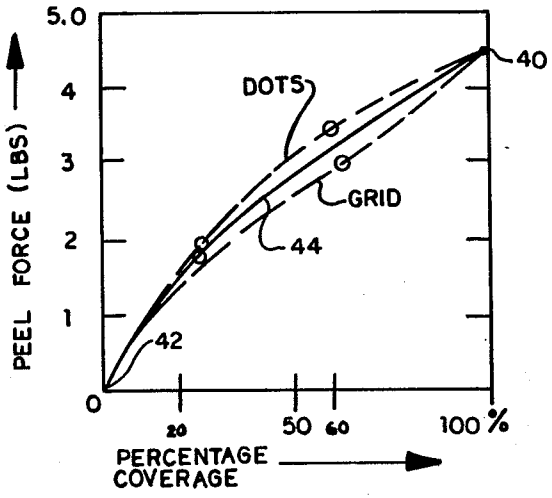
FIG. 4 is a graph showing the relationship between the required peel force and the percentage of coverage of the patterned adhesive employed in the labels illustrating the present invention.

FIG. 4 is a graph showing the peel force in pounds plotted against the percentage coverage for a rubber based, hot melt, permanent adhesive having a 100% coverage peel strength of approximately 4.5 pounds per one inch strip. This valve of 4.5 pounds is indicated at point 40 which appears at the right-hand side of FIG. 4, at 100% coverage. Of course, as indicated by point 42, at zero coverage, no force would be required to peel the label from the substrate. Tests were made with both a pattern of dots, and with a grid, using 25 lines per inch, and using 25 dots per inch, for the grid and the dots, respectively, with increasing width of the lines and increasing size of the dots for increasing coverage. Slight differences of peel strength were noted both for the 20% coverage and for the 60% coverage, the levels of coverage at which tests were made. In each case, the sample with the dots produced slightly higher levels of the peel force which was required, as compared with the comparable coverage for the grid. Accordingly the plots for the dots and the grid have been shown separately in dashed lines. However, because the two sets of readings are within the experimental error of the tests, principal emphasis should be given to the curve 44 which is an average of the peel forces obtained with the dot pattern and with the grid patterns.

As mentioned above, readings as shown in FIG. 4 were obtained with a rubber based, hot melt, permanent adhesive. When other self-adhesive materials are used, it would be expected that the characteristics would be similar to those shown in FIG. 4, but with the 100% coverage point shifted, of course, to match the full coverage peel force of the adhesive under consideration. Thus, instead of the hot melt permanent adhesive having a full coverage peel force of 4.5 pounds per inch, a solvent-type permanent adhesive may have a full coverage peel strength of approximately 3.0 pounds; a solvent acrylic permanent adhesive may have a peel force of approximately 3.9 pounds; a solvent-type removable adhesive may have a peel of approximately 0.7 pounds; a hot melt removable self-adhesive may have a peel strength of approximately 0.9 pounds; and a solvent-based high strength adhesive could have a full coverage peel force of up to 6 pounds. Other types of adhesives including acrylic-based hot melt permanent adhesives could also be employed. In each case, it would be expected that the curves would be comparable to those of FIG. 4, with the characteristic extending from the origin at the lower left to the full coverage peel force at the 100% coverage level, and being moderately linear but slightly bowed upward in a manner similar to charactistic 44 of FIG. 4.

Figure 5:
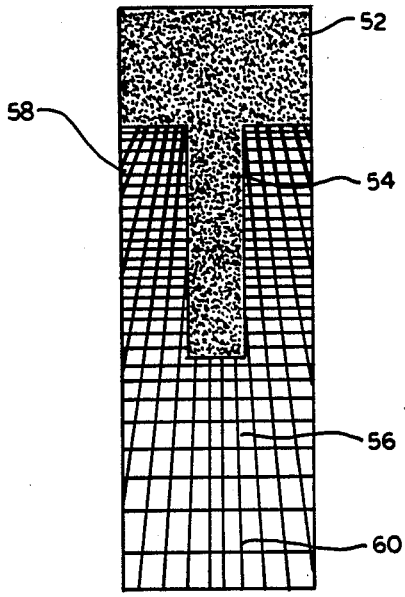
FIG. 5 shows the adhesive side of an alternative label configuration in which the patterned adhesive varies continuously from a full coverage to a very light coverage pattern.

FIG. 5 shows an alternative form of label which could be used for applications similar to that shown in FIG. 1. More particularly, referring to FIG. 5, there is a T-shaped full coverage area 52, extending down through the ares 54 which may be considered to be the leg of the "T".

A radiating pattern of adhesive lines extends over the remaining area 56 of the label, with the lines being somewhat heavier in the upper area 58, and with the lines of adhesive being somewhat narrower and more widely spaced toward the bottom 60 of the label. This configuration has the advantage that is easier to start unpeeling the label at the bottom corners adjacent the areas 60, and that the flap on the carton or box which will underlie the area 54 may be opened progressively, in accordance with the amount of pull applied to the lower end 60 of the label. Thus, if it is only desired to pour slowly from the pouring spout, there is no need to apply heavy force and open the underlying flap on the carton or box wide. Instead, only moderate force need be applied to the lower end of the label 60, and the pouring flap might only be opened half way, for example. However, as in the case of the label of FIGS. 1 and 2, the light pattern of adhesive on the lower portion of the label is adequate to hold the label in place properly resealed, and therefore closing the underlying flap on the carton or product box.

Figure 6:
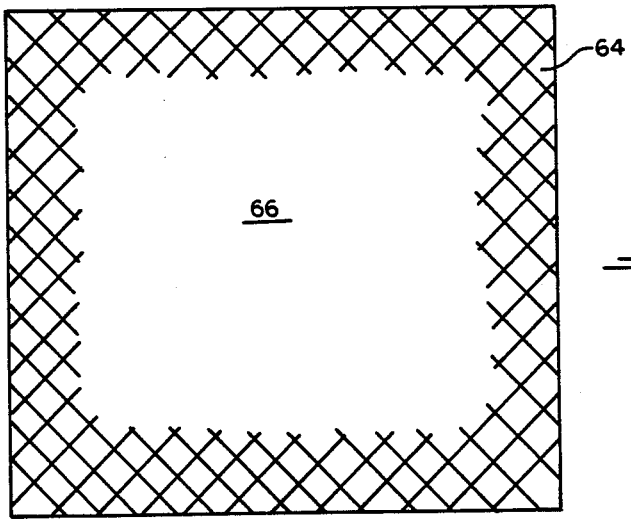
FIG. 6 shows a perimeter adhesive container seal.

In the showing of FIG. 6, a fine perimeter pattern 64 of adhesive material is employed, with the center area 66 of the label being covered with adhesive material. The arrangement of FIG. 6 is relatively economical, in that thin lines of a permanent adhesive may be employed instead of full coating of a removable or resealable adhesive. In addition, the center area being free of adhesive prevents contamination of the product, in the case of products which are entirely sealed by the label.

Figure 7:
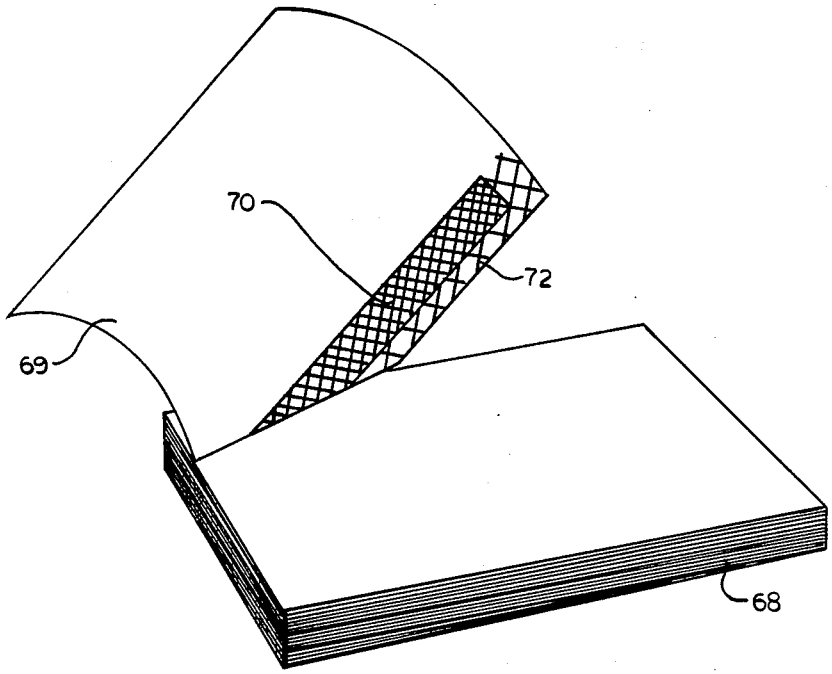
FIG. 7 shows a note paper system in which two different percentage coverage patterns are employed to control adhesion and to prevent curling of the notes.

FIG. 7 shows a pad 68 of removable notes in which the individual notes could, for example, be selectively stuck onto a legal paper or other location on a temporary basis, where it can be easily removed when desired. Each note 69 has a relatively heavy pattern of adhesive 70 located at the top thereof, but slightly spaced from the edge of the particular note. Around the periphery of the heavy adhesive pattern 70 is a lighter pattern of adhesive 72 which provides additional adhesion and also serves to prevent curling of the notes when they are removed from the pad. Varying peel strength adhesives both permanent and resealable, may be used; and if a low peel strength self-adhesive is used, the area 70 may be full coverage, with the same adhesive but in a light pattern used in area 72.

Figure 8:
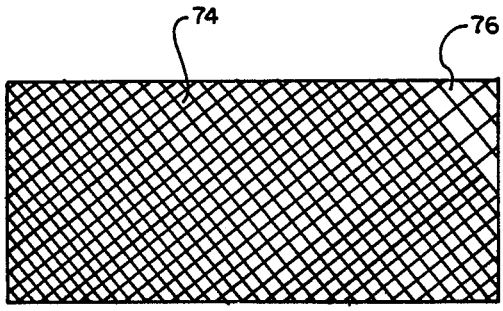
FIG. 8 shows a label having an adhesive pattern in which one corner is provided with a very light pattern of adhesive to facilitate starting the removal of the label.

The label of FIG. 8 has a generally heavy pattern of adhesive 74 extending over most of its area, but has a relatively light pattern 76 at one corner. Accordingly, after the label has been applied, it may still be relatively easily removed, by starting from the corner 76.

Figure 9:
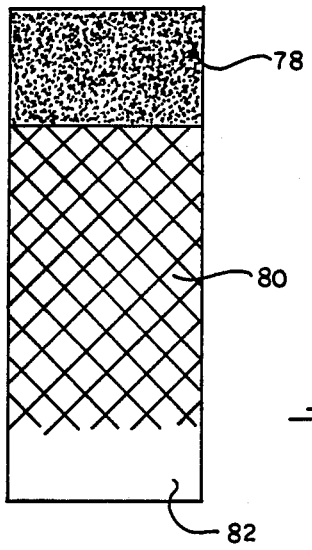
FIG. 9 shows still another alternative label which may operate as a resealable package closure.

FIG. 9 shows still another alternative type of label, including full coverage in the area 78 where permanent adhesion is desired, and relatively lighter pattern coverage in the area 80 where the label is to be resealed, and finally, the ungummed area 82 where the label is free of adhesive so that you can easily start to raise the label.

Figure 10:
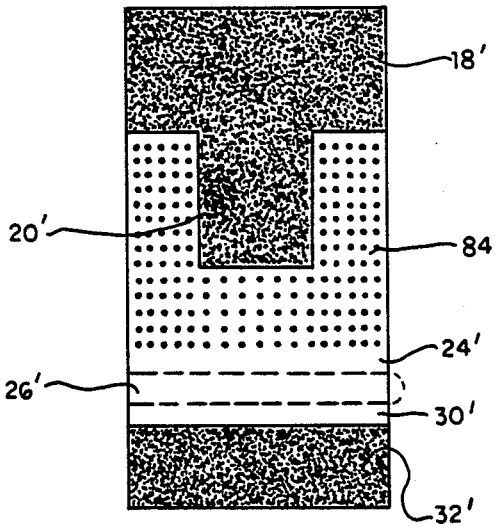
FIG. 10 shows an embodiment of the invention similar to that of FIG. 2 but wherein dots are employed instead of a cross-hatched fine pattern of adhesive.

FIG. 10 shows a label which is similar to that of FIG. 2, and accordingly has reference numerals which are generally comparable to those of FIG. 2. Thus, the label of FIG. 10 includes the upper T-shaped fully coated adhesive area 18' and a similar lower area 32', in addition to the tear strip 26' extending across the ungummed area. However, instead of the patterned area 22 of FIG. 2 which is covered by cross-hatched lines of adhesive, the label of FIG. 10 has a finely spaced dot pattern in the area 84, providing the resealing action accomplished by the similar area 22 of FIG. 2.

In conclusion, it is to be understood that the foregoing description and the accompanying drawings relate to specific illustrative embodiments of the invention. Various changes and alternative constructions may be employed in the implementation of the present invention. Thus, by way of example but not of limitation, a label may be provided with full adhesive coverage at one end, and continuously decreasing coverage to the other end thereof, with successive spots of full coverage intended to be aligned with and to remove successive perforated openings in a product carton containing granulated product. Then, when the label is only partially folded back, products may be dispensed through a single opening, while further retraction of the label by the application of additional force, will open additional dispensing holes in the carton so that the products may be dispensed more rapidly. In addition, instead of cross-hatched lines, sets of parallel lines may be employed as the patterned adhesive, and the fine pattern may be in parallelogram, triangular, or other configurations. Accordingly, the present invention is not limited to the precise embodiments as shown in the drawings and as described in detail hereinabove.

It is further noted that it is planned that a copending patent application having at least some of the same drawings and specification as this case will be filed to be copending with this patent application, but directed to different features.

We claim:

1. A combined dispensing label and product container comprising:

a product container having a flap opening along a hinge line;

a label having a permanent pressure-sensitive adhesive therein for covering said flap opening;

said label having substantially full permanent pressure-sensitive adhesive coverage engaging said flap and extending beyond said hinge line to permanently secure said label to said flap and to said container beyond said hinge line;

said label having a light, fine pattern of said permanent pressure-sensitive adhesive around the edges of said label extending around said flap and constituting means for resealably engaging said product container to resealably close said flap;

the permanent pressure-sensitive adhesive in said full adhesive coverage being of the same composition as that in said light, fine pattern of adhesive, so that the entire adhesive pattern on said label may be applied to said label in a single coating operation.

2. A combined dispensing label and product container as defined in claim 1 further comprising an ungummed area on said label spaced beyond said light fine pattern of adhesive, for gripping said label to peel the label back.

3. A combined dispensing label and product container as defined in claim 1 wherein said light, fine pattern of adhesive is formed of a pattern of lines of adhesive.

4. A combined dispensing label and product container as defined in claim 1 wherein said light, fine pattern of adhesive is formed of a pattern of dots of adhesive.

5. A combined dispensing label and product container as defined in claim 1 wherein said fine pattern of adhesive has a percentage of adhesive coverage which is less than 50%.

6. A combined dispensing label and product container as defined in claim 1 wherein said fine pattern of adhesive has no substantial areas of adhesive which are more than one-sixteenth inch square.

7. A combined dispensing label and product container as defined in claim 1 wherein said fine pattern is made up of a series of lines of adhesive and the width of said lines is less than 0.050 inch.

8. A combined dispensing label and product container as defined in claim 1 wherein said fine pattern is made up of a series of lines of adhesive and said lines have a thickness which is less than 0.030 inch.

9. A combined dispensing label and product container comprising:

a product container having a flap opening along a hinge line;

a label having a permanent adhesive thereon for covering said flap opening;

said label having substantially full adhesive coverage engaging said flap and extending beyond said hinge line to permanently secure said label to said flap and to said container beyond said hinge line;

said label having a light, fine pattern of said permanent adhesive around the edges of said label extending around said flap and constituting means for resealably engaging said product container to resealably close said flap;

said label including a second fully adhesive coated area at the end thereof beyond said light fine pattern of adhesive; and a tear strip extending across said label adjacent said second fully adhesive coated area.

10. A label comprising face stock and permanent pressure-sensitive adhesive on one side of said face stock, said permanent pressure-sensitive adhesive having a first full coverage area on said face stock for permanently adhering to a substrate, said label including means in a second area of said label for permitting peeling and resealing of said label in said second area, said means constituting said permanent pressure-sensitive adhesive coated in a fine pattern on said second area of said label; said label including a second fully adhesive coated area at an end thereof beyond said fine pattern of adhesive; and a tear strip extending across said label adjacent said second fully adhesive coated area.

11. A label comprising face stock and permanent pressure-sensitive adhesive on one side of said face stock, said permanent pressure-sensitive adhesive having a first full coverage area on said face stock for permanently adhering to a substrate, and said label including means in a second area of said label for permitting peeling and resealing of said label in said second area, said means constituting said permanent pressure-sensitive adhesive coated in a fine pattern on said second area of said label, said fine pattern includes radiating lines of adhesive to progressively change the percentage coverage of adhesive.

* * * * *